United States Patent [19]

Hartness

[11] Patent Number: 4,848,651

[45] Date of Patent: Jul. 18, 1989

[54] CARTON FOR SHIPPING OR DISPLAYING OF ARTICLES

[75] Inventor: Thomas S. Hartness, Greenville, S.C.

[73] Assignee: Hartness International, Inc., Greenville, S.C.

[21] Appl. No.: 230,570

[22] Filed: Aug. 10, 1988

[51] Int. Cl.[4] ..... B65D 5/28

[52] U.S. Cl. ..... 229/125.33; 229/125.19; 229/129; 229/23 BT; 206/427; 206/601; 206/602

[58] Field of Search ..... 229/125.19, 129, 23 BT, 229/120.32, 40, 125.33; 206/602, 427, 429, 431, 192, 631

[56] References Cited

U.S. PATENT DOCUMENTS

| | | | |
|---|---|---|---|
| 1,431,133 | 10/1922 | Young | 206/45.23 |
| 1,767,733 | 6/1930 | Brown | 229/154 |
| 2,219,039 | 10/1940 | Young | 206/45.23 |
| 2,342,894 | 2/1944 | Quartin | 206/45.23 |
| 3,019,959 | 2/1962 | Skowronski | 206/631 |
| 3,245,527 | 4/1966 | Martin | 206/427 |
| 3,257,065 | 6/1966 | Bowman et al. | 229/3.5 R |
| 3,314,587 | 4/1967 | Johnson | 206/602 |
| 3,436,893 | 4/1969 | Vokes et al. | 229/125.19 |
| 3,743,167 | 7/1973 | Russell | 229/23 BT |
| 3,810,573 | 5/1974 | Russell et al. | 229/23 BT |
| 3,958,746 | 5/1976 | Wilbur | 206/459 |
| 4,397,387 | 8/1983 | Bidegain | 206/45.23 |
| 4,471,870 | 9/1984 | Uhlig | 206/427 |

FOREIGN PATENT DOCUMENTS

| | | | |
|---|---|---|---|
| 2571336 | 4/1986 | France | 229/129 |

*Primary Examiner*—Stephen Marcus
*Assistant Examiner*—Jes F. Pascua
*Attorney, Agent, or Firm*—Dority & Manning

[57] ABSTRACT

A carton is disclosed for use in storing, transporting and displaying a plurality of articles and including a base member for supporting the articles and a top cap cover telescoping over the articles and upturned panels of the base member. The cover is detachably connected to the base member by adhesive material applied to the corners of the base member. To remove the cover, a user inserts his fingers between adjacent panels of the cap cover and base member and quickly extends his hands outwardly to break the adhesive binding thereby releasing the cover for removal.

9 Claims, 4 Drawing Sheets

Fig. 1.
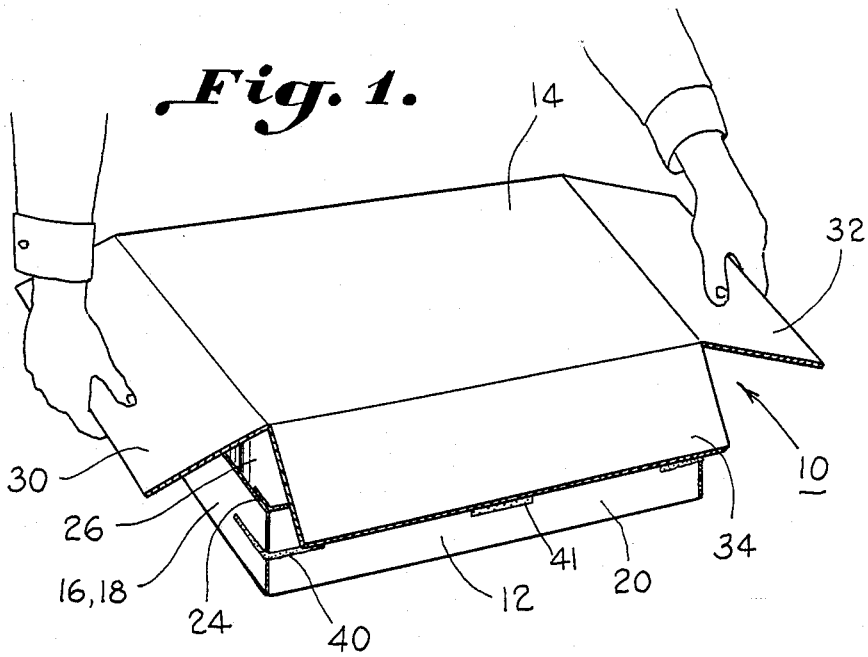
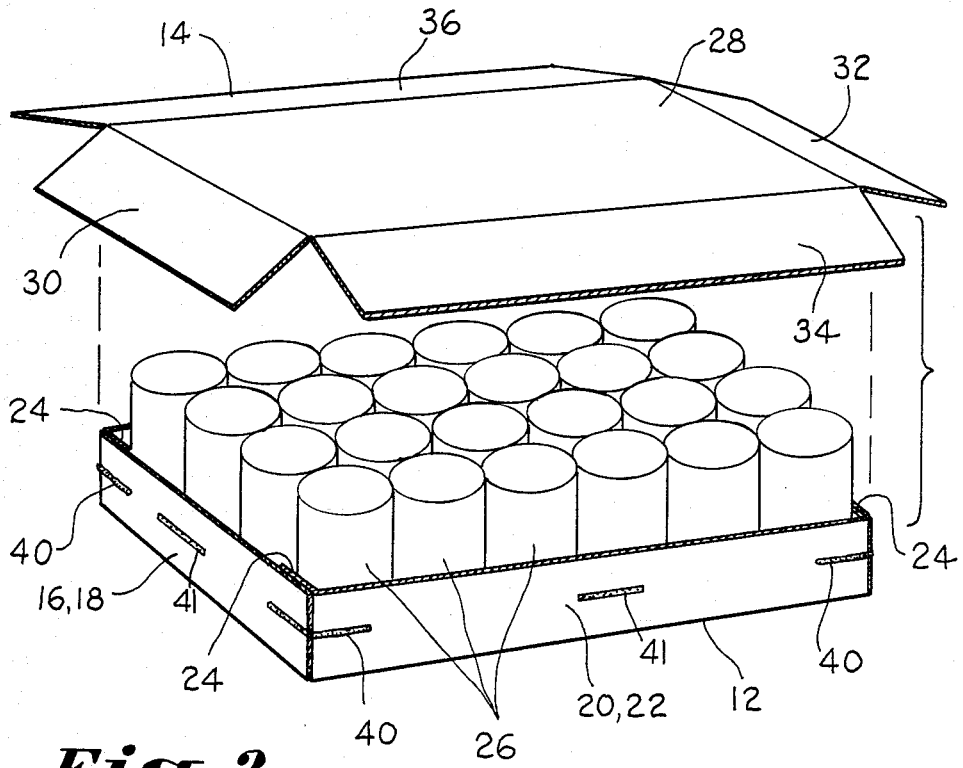
Fig. 2.

CARTON FOR SHIPPING OR DISPLAYING OF ARTICLES

BACKGROUND OF THE INVENTION

This invention relates generally to a carton useful for shipping and displaying articles contained therein and particularly to cartons used in shipping and displaying grocery items devised for permitting the opening of the carton with the use of tools.

It has been reported by grocery store chains that considerable amounts of money are lost each year due to inadvertent cutting of grocery items because of the use of tools such as knives for the cutting and opening of cartons containing various grocery items. In particular, these losses have occurred when the carton contains cereal boxes or other grocery items which utilize cardboard boxes, paper bags and the like as articles contained in the cartons. Besides soft food containers mentioned above being damaged by means of the use of knives by store clerks for opening the original shipping containers, damages also incur to hard form articles contained in cartons, such as food containers which are made of plastic. Even bottle caps have been damaged by inadvertent use of knives or other tools to facilitate the opening of original containers.

Some shipping containers utilize very heavy duty staples which must be removed before carton flaps can be folded back to expose the contents of the container. Such tools as screwdrivers, hammers, knives and other elongated forms of devices are utilized to pry open individual staples thus, effecting damage to the articles contained in the container adjacent the top cover being opened.

In either of these events, time is expended in order to accomplish opening of the shipping carton. After opening, the portions of the carton remaining after removal of the parts thereof to permit either a display of the contents or removal thereof occupy considerable space especially when many cartons are being opened in a particular area. These situations in turn require additional time and manpower to condition the expended portions of the container so that the same may be placed in piles for disposal.

In the prior art, U.S. Pat. No. 3,958,746 discloses a shipping case particularly devised for minimizing the effect of the use of opening a large box to expose ready to eat cereal cartons and the like. The disadvantage with this type of shipping box is that a knife blade must still be used in order to open the box, and the potential for damage to the contents of the shipping and also possible injury to the shipping clerk, still remains. The shipping box disclosed in this patent is relatively complex, is not readily and easily fabricated, and results in expended parts which must be handled once again in order to condition the same for eventual disposal.

A display box is disclosed in U.S. Pat. No. 4,397,387 which is relatively complicated for use as a shipping container for articles to be transported and/or displayed. The box basically comprises a lower portion for containing articles to be displayed and an upper cover pivotally related thereto so that the cover is adapted to be readily opened to expose the articles. For low priced grocery items this type of box would be far too expensive for economical merchandising. Furthermore, the two basic portions of the box are not easily flattened in order to permit disposal thereof.

In U.S. Pat. No. 3,257,065, a single carton blank is disclosed as being devised to form a carton having a lower member for containing articles to be shipped or displayed and a top pivotal cover for closing the lower member. The blank includes numerous foldable flaps having glue applied thereto at specific locations in order to provide a carton for goods such as frozen items and to protect these against loss of moisture. In some uses the carton may be used for goods for protecting the same against the moisture from atmosphere. In any event, the removal of the cover for the carton would require considerable amounts of manual handling and the prospect that a knife blade may be necessary to augment this effort.

In U.S. Pat. Nos. 2,342,894, 2,219,039 and 1,431,133, display boxes are disclosed which are comprised essentially of a base portion and a cover pivotally mounted thereon in order to permit exposure to the interior of the base member and displaying of the article therein. These boxes are relatively complex and therefore not suitable for shipping and disposal thereof after the articles contained therein are removed. These boxes are relatively expensive and cannot be considered disposable after a single use or shipment. A single blank foldable box is disclosed in U.S. Pat. No. 1,767,733 which blank does not need adhesive material in which to hold the various panels and flaps included therewith. Rather than adhesive material various locking flaps and tongues are utilized in cooperation with slots to assist in folding the panels into a box configuration. While the box may be very quickly and easily assembled and locked so that it can be handled roughly, many manipulative steps must be taken in order to unlock the locking devices in order to expose the contents of a box. More than likely a store clerk would utilize a knife blade to effect quicker opening of the box thereby increasing the opportunities of damaging the contents by use of such a tool.

In order to overcome the disadvantages described above, the present invention was devised so that the cover of the carton may be easily removed manually without the use of a knife blade or other tool and which when removed may be easily flattened for tieing, stacking, and removal. The parts of the carton are very simple in construction, may be easily fabricated and assembled, and when assembled, are capable of easy carrying, transporting and stacking for storage purposes without damaging the carton or its contents.

The carton of the present invention comprises two members each of which is formed from simple blanks and when joined together in telescoping fashion provide a compact carton suitable for rough handling and shipping. The base member of the carton utilizes upturned edge panels which are held erect by flaps suitably glued to the panels. The edge panels extend upwardly but are of a height less than the height of the articles being supported by the base member. The cover cap member which serves as the top member for the carton has edge panels corresponding to the edge panels of the base member. The corresponding edge panels are attached at their ends by adhesive material applied to the corners of the base member, thereby leaving midportions of the panels free to permit the insertion of the fingers of a store clerk and the quick manual separation of opposite edge panels. Such quick movement by the user will separate the portions of the panels which are attached by the adhesive material. These manipulative actions are applied to the side panels of the top cover in one movement and the end panels by another movement, thereby completely releasing the top cover cap from the carton and exposing the contents therein. Such action to remove the top cover conditions the same for stacking with other such covers for the eventual disposal thereof.

Therefore, it is a principal object of the present invention to permit the opening of a carton containing articles by simple manipulative steps only, and without the aid of external tools.

It is another object of the invention to utilize a shipping carton suitable for display comprising simple and inexpensive parts which are very easy to fabricate and assemble and which incurs little loss when disposed of after only a single use.

BRIEF DESCRIPTION OF THE DRAWINGS

Other objects and advantages will become apparent from the following description taken in conjunction with the accompanying drawings, wherein:

FIG. 1 is a perspective view of the carton of the present invention showing the top cap cover being removed from the carton;

FIG. 2 is a perspective view of the carton showing the cover removed from the carton;

DESCRIPTION OF THE PREFERRED EMBODIMENTS

Figure 3:
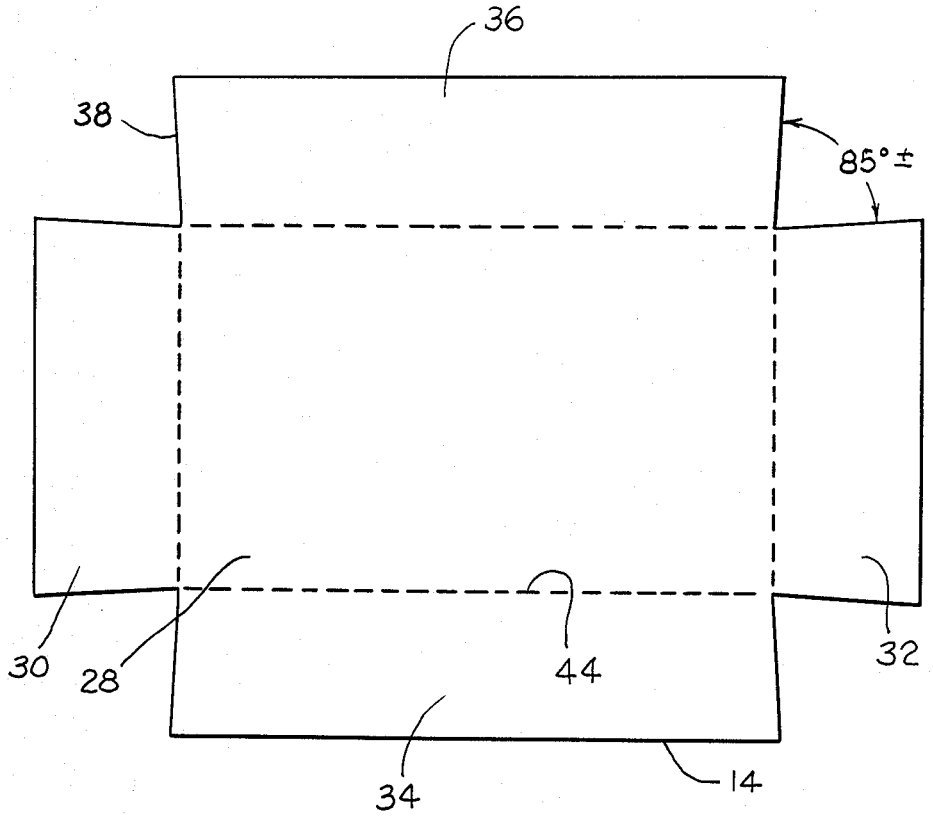
FIG. 3 is a plan view of a blank for the top cap cover.

Referring to FIGS. 1–4 of the drawings, a carton generally indicated by the reference numeral 10 and devised in accordance with the present invention is shown as comprising a lower base member 12 and an upper detachable cap cover 14.

The base member 12 is formed from a blank having front and rear base panels 16, 18, respectively, and side base panels 20, 22, respectively. The panels 16, 18, 20, and 22 are held upwardly in erect positions by suitable flaps 24 hingedly secured to the ends of each of the side base panels 20, 22. When assembled as shown in FIG. 2, the base member serves to support a plurality of grocery items such as food cans 26. When erected the height of the panels 16, 18, 20 and 22 are less than the articles 26 supported in the base member, preferably to a distance of approximately half of the height of the articles. In this manner, the articles 26 are arranged for permitting display of pertinent information printed thereon and/or removal of the articles for distribution.

The upper cap covered member 14 as shown in FIG. 3 comprises a blank formed with a rectangular portion 28 having hinged front and rear cover panels 30, 32 and side panels 34, 36.

As shown in FIG. 3, when the blank for the cover 14 is in flattened condition, cutouts 38 are formed in the four corners of the blank. Each of the cutouts 38 is formed by the adjacent end edges of the respective front, rear, and side cover panels. The end edges of the panels are cut so that the angular relationship between the adjacent end edges which define the cutout 38 is less than 90°, preferably between 80°–84°. In this manner, each of the panels 30, 32, 34, and 36 is tapered slightly from their outer respective edges toward their connection with the rectangular portion 28 of the blank. The purpose for this angular relationship will be discussed below.

When the carton cap cover 14 and the base member 12 are assembled, the cover panels 30, 32, 34, and 36 are folded downwardly and applied to the base member 12 in telescoping fashion so that the front and rear base panels 16, 18, and the side base panels 20, 22, are overlapped, respectively. When fully assembled, the rectangular portion 28 of the cap cover 14 rests upon or nearly so on the articles 26 in order to eliminate any space therebetween so that upon stacking of the cartons 10 no damage is inflicted to the cartons. The cover cap 14 is detachably secured to the base member 12 by means of lines of adhesive material 40 applied to the four corners of the base member. The lines of adhesive material 40 are applied to the end portion of each of the base panels 16, 18, 20, and 22 thereby leaving mid-portions of these base panels free of the material.

Figure 4:
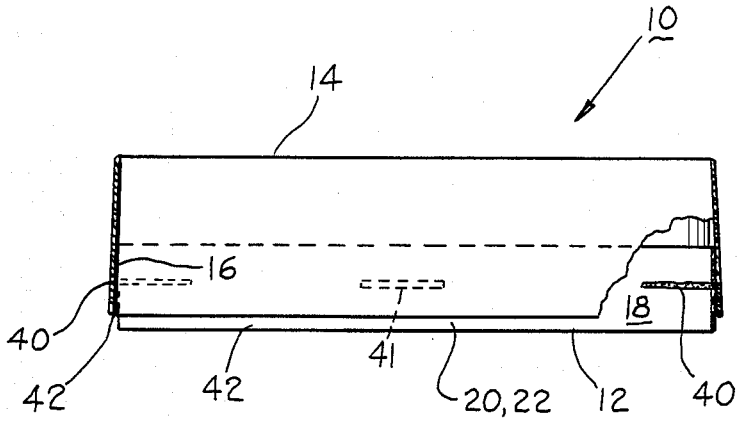
FIG. 4 is an elevational view of the carton partly cut away to show a detail thereof.

With the carton 10 is fully assembled, as shown in FIG. 4, the cover panels 30, 32, 34, and 36 extend downwardly for a dimension slightly less than the total height of the carton so as to leave a space 42 for facilitating the insertion of a user's fingers between facing panels. It is to be noted in FIG. 4, that the carton 10 tapers slightly inwardly in a direction from top to bottom of the carton. This tapering is produced by the angular relationship previously described between the adjacent end edges of the top cover panels. In this manner, when the cap panels 30, 32, 34, and 36 are folded downwardly in assembled condition, the adjacent end edges of the panels completely close in their abutting relationship so that spacings therebetween are eliminated. The slightly tapering effect of the carton at its upper or top side ensures that the articles 26 are held from movement or excessive movement during shipping or handling of the cartons.

To disassemble the carton 10 in order to display the articles 26 or to permit removal therefrom, a user such as a store clerk merely inserts the fingers of both hands, as shown in FIG. 1, between adjacent cover and base panels. For example, the user would insert his right-hand fingers between the base panel 16 and cover panel 30 and the fingers of his left hand between the base panel 18 and cover panel 32. A smart movement of his hands outwardly will easily break the adhesive relationship between these panels which were established by the adhesive material 40 so that the panels will be free from the base manner. Likewise, the user will insert his fingers between the base panel 20 and the cover panel 34 on the one hand and the base panel 22 and the cover panel 36 on the other hand at the mid-portions thereof. Again, by a smart, quick movement of the hands outwardly will release the cover panels 34, 36, from attachment to the base member thereby completely freeing the assembly of the parts and presenting the top cover in a flattened condition, as shown in FIG. 2, for stacking with similar top cover members for eventual disposal thereof.

In the event the user wishes to remove only one of the cover panels 30, 32, 34, or 36 to effect only a partial display of the articles, the blank in FIG. 3 may be formed with liner of perforation 44 along the folds between each of the cover panels and the portion 28. After detaching one of the cover panels, the same may be torn loose from the cap cover 14 to expose the articles 28.

Figure 5:
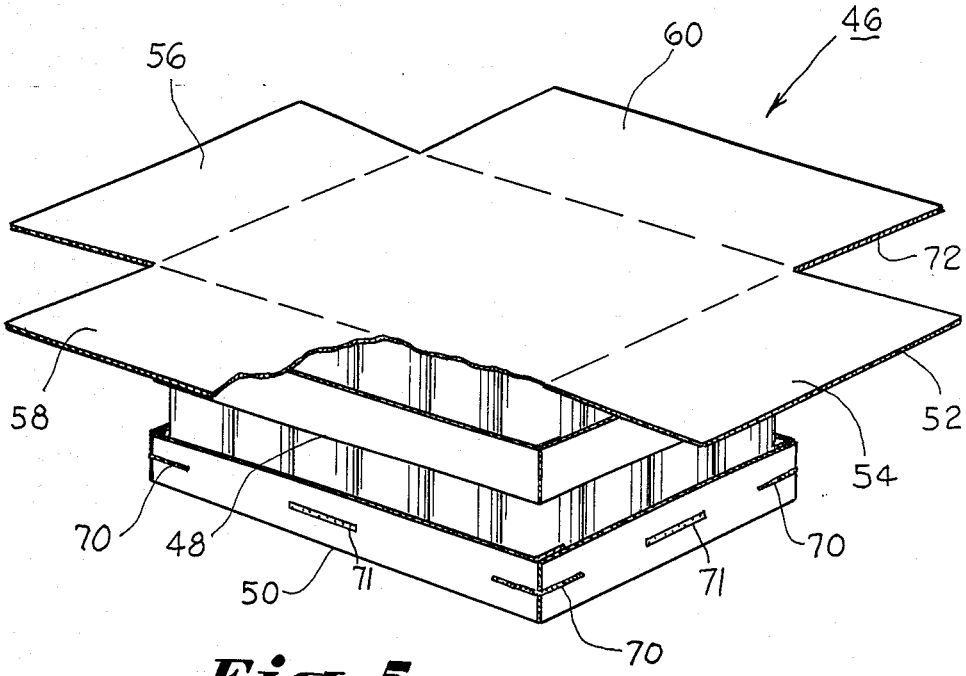
FIG. 5 is an isometric view of another embodiment of the present invention.

In the embodiment of FIG. 5, a carton, generally indicated by the reference numeral 46 is shown as including upper and lower base members 48, 50 and a top cap cover 52. Each of the base members 48, 50 are identical to the base member 12 of the embodiment of FIGS. 1–4 while the top cap cover 52 is similar to the top cap cover 14 but includes front, rear, and side panels 54, 56, 58 and 60, respectively, which are wider than the corresponding front and rear side panels of the cover 14. In this manner, the front, rear, and side panels of the cap cover 52 are adapted to extend in telescoping fashion the depth of the combined heights of the base members 48, 50.

When the carton 46 is fully assembled, the front cover panel 54, the rear cover panel 56, extend downwardly beyond the corresponding base panels of the base member 48 and to the corresponding pase panels of the base member 50. Similarly, the side cover panels 58, 60 extend beyond the corresponding cover panels at the base member 48 and to the corresponding base panels of the base member 48. The front cover panel 54, the rear cover panel 56 and the side base panels 58, 60 and are detachably attached to the lower base member 50 by lines 70 of adhesive material applied at the corners of the base member 50. Similarly the top cap cover 52 is formed with cutouts 72 at each corner thereof to serve the same function as the cutouts 38 in the embodiment of FIGS. 1–4.

The disassembly of the carton 46 is the same as the disassembly of the carton 10 in that the operator inserts the fingers of both hands at the mid positions of the corresponding opposed panels and to quickly move his hands outwardly to detach the opposed panels of the cover 52 from the corresponding opposed panels of the base member 50 for detachably separating the panels held together by virtue of the line 70 of the adhesive material. While not illustrated, the corners of the base member 48 may also have adhesive material applied thereto to provide additional strength to the carton.

The embodiment of FIG. 5 permits the displaying, shipping, or handling of more than one base member which supports various forms of articles. While only two base members are shown in FIG. 5 it is understood that three or four and even additional base members may be stacked one upon another and a corresponding cover applied thereto. It is also understood that lines of adhesive material may be applied to the upper base member 48 and any other base member used to form the carton 46.

It is further understood that lines of adhesive material 41 and 71 may be applied to the mid-portions of the base members 12, 48 and 50, respectively of the embodiments of FIGS. 1–4 and 5, if additional strength is found to be necessary. In this event, the material is to be applied in small amounts and in areas which will not interfere with the user's fingers.

Figure 6:
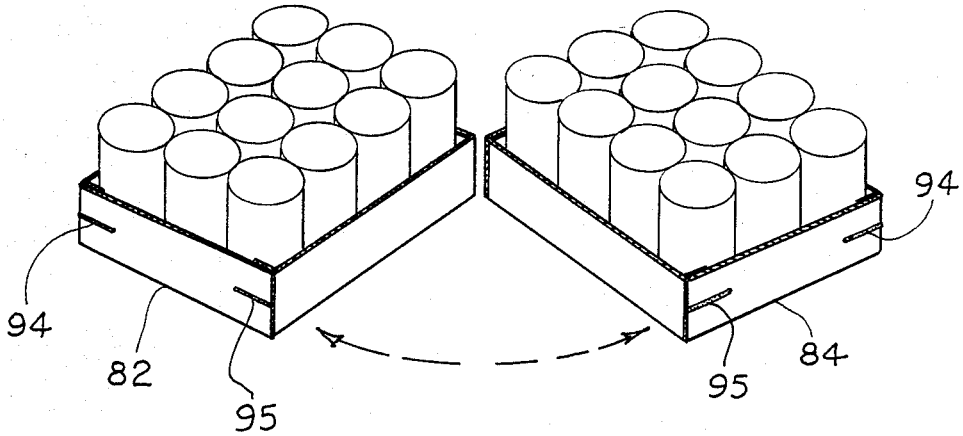
FIGS. 6, 7, and 8 are perspective views of still another embodiment of the present invention in various stages of assembly.
Figure 7:
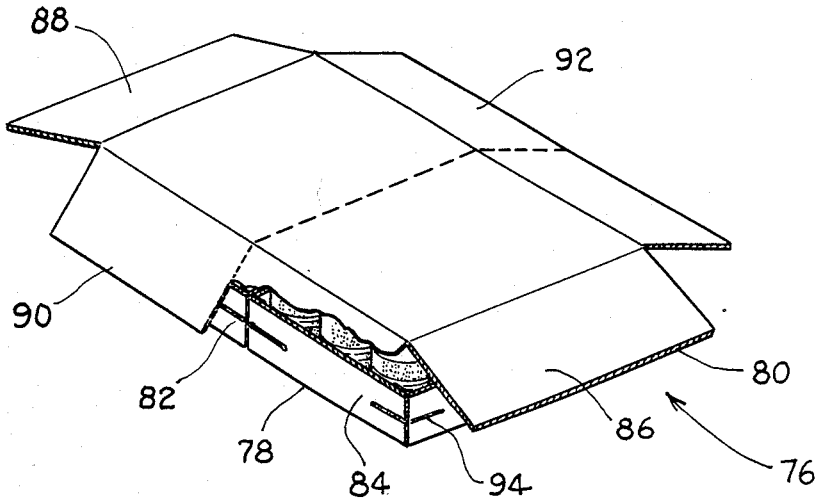
Figure 8:
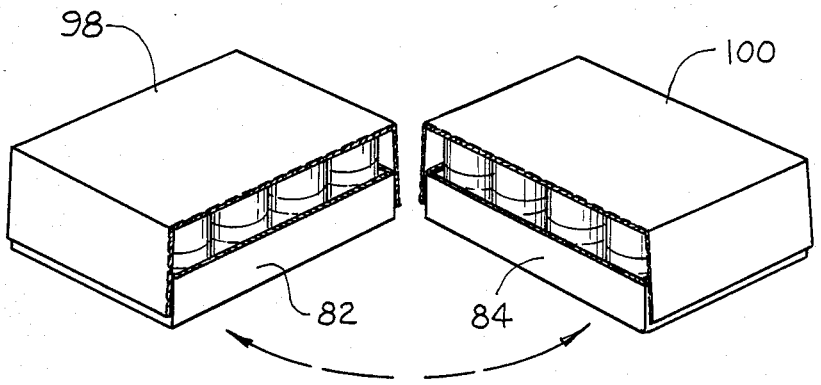

The embodiment of FIGS. 6–8 takes advantage of utilizing twin-pack packaging of articles to be displayed, shipped, or handled. In FIG. 7, the carton 76 is shown as comprising a base member 78 and a cap cover member 80. The base member 78 comprises two identical sub-base members 82, 84 which, when the carton 76 is assembled, are in side-by-side relationship as shown in FIG. 7. When assembled the front, rear, and side cover panels 86, 88, 90 and 92 overlap the corresponding front, rear, and side base panels of the combined base member 78. Lines of adhesive material 94 are applied to the four corners of the combined base member and at midpoints 95 thereat for detachably securing the front, rear, and side panels of the cap cover 80.

The top cap cover 80 is formed with a score line 96 which when assembled overlies the line of separation between the sub base members 82, 84. The score line 96 may be in the form of a line of perforations which will allow the user such as a store clerk to separate the carton 76 into two separate twin pack portions of the carton illustrated in FIG. 8 as portions 98 and 100. Each of the carton portions 98, 100 may be disassembled in a manner which was utilized to separate the carton parts of carton 10 of embodiment of FIGS. 1–4. The embodiment of FIGS. 5–8 permits the breaking down of a relatively large carton into smaller sub cartons to facilitate easily handling if such is necessary.

The present invention also envisions that either or both of the end flaps 30, 32, may for example, in the embodiment of FIGS. 1–4 be removed prior to assembly of the carton 10, not part of the original blank thereby permitting display of the end articles while the cartons are being handled or stored.

From the foregoing, it will be appreciated that the present invention, as applied to the various embodiments described comprises relative simple and economical parts which when assembled in the manner discussed provides a means for permitting a user to quickly disassemble the carton for display and shipping purposes without the use of any external tools such as a knife blade thereby completely eliminating damage to articles being displayed or handled. It will also be appreciated that the assembled cartons may be stacked for storage purposes without exposing any of the cartons to damage due to weight produced by stacking.

While a preferred embodiment and other embodiments have been described herein as illustrative of the present invention, it is to be understood that the invention is not to be limited to the exact details of construction and the other forms or embodiment may be derived therefrom, such as obvious modifications to one skilled in the art.

What is claimed is:

1. A carton for shipping and/or displaying articles comprising a base member for supporting the articles and completely detachable top cap member, said base member having bottom panel, front, rear and side base panels attached to and upstanding from the bottom panel a distance less than the height of the articles and retained erect by corner flaps thereby forming base corners, said top cap member being formed with a top panel having front, rear and side cover panels depending from said top panel and being arranged to overlap said front, rear and side base panels of said base member, respectively, said front, rear and side panels of said top cap member being attached to said overlapped corresponding front, rear and side panels of said base member by adhesive material at said base corners, said front, rear and side cover panels being readily separable at their mid-portions from corresponding mid-portions of said front, rear and side base panels, respectively, to permit the insertion of a user's fingers therebetween and the removal of said top cap member by manual separation of the attached panels and lifting thereof.

2. The carton defined in claim 1, wherein said front, rear and side cover panels of said top cap member depending a distance less than the height of the carton to facilitate the insertion of the user's fingers.

3. The carton defined in claim 1 wherein the mid-portions of said front, rear and side base panels have adhesive material applied thereto to add strength to the assembled carton.

4. The carton defined in claim 1 wherein said top cap member is formed with a line of perforations between the edges of said top panel and at least one of said cover panels for permitting the complete removal of that panel.

5. A carton for shipping and/or displaying articles comprising a base portion having two or more superimposed separated base members for supporting the articles and a completely detachable top cap member, each of said base members having a bottom panel, front, rear and side base panels attached to and upstanding from the respective bottom panels a distance less than the height of the articles supported thereon and retained erect by corner flaps thereby forming base corners for each of said base members, said top cap member being formed with a top panel having front, rear and side cover panels depending from said top panel and being arranged to overlap said front, rear and side base panels of said base members, respectively, said front, rear and side panels of said top cap member being detachably attached to said overlapped corresponding front, rear and side base panels of at least the lowermost of said base members by adhesive material applied at said base corners of the lowermost of said base members said front, rear and side cover panels being readily separable at their mid-portions from corresponding mid-portions of said front, rear and side base panels, respectively, to permit the insertion of a user's fingers therebetween and the removal of said top cap member by manual separation of the attached panels and lifting thereof.

6. The carton defined in claim 5 wherein the mid-portions of said front, rear and side base panels of the lowermost of said base members have adhesive material applied thereto to add strength to the assembled carton.

7. A carton for shipping and/or displaying articles comprising a base portion having two side-by-side side positioned base members abutting along a common separation line for supporting the articles and a completely detachable top cap member, each of said base members having upstanding base panels extending a distance less than the height of the articles and being retained erect by corner flaps, said base portion having base corners formed by two corners of each of said base members, said top cap member having depending cover panels arranged to overlap corresponding panels of said base portion, said cover panels being detachably attached to said overlapped corresponding base panels of said base portion by adhesive material at said base corners, said cover panels being readily separable at their mid-portions from corresponding mid-portions of said base panels to permit the insertion of a user's fingers therebetween and the removal of said cap member by manual separation of the attached panels and lifting thereof.

8. The carton defined in claim 7 wherein said top cap member is formed with means to divide the same in two portions along a line contiguous to said common line to permit separation of the carton into twin packs.

9. A carton for shipping and/or displaying articles comprising a base member for supporting the articles and a completely detachable top cap member, said base member having bottom panel, front, rear and side base panels attached to and upstanding from the bottom panel a distance less than the height of the articles and retained erect by corner flaps thereby forming base corners, said top cap member being formed with a top panel having side cover panels and front and rear panels depending from said top panel and being arranged to overlap said side base panels and said front and rear panels of said base member, respectively, said side panels of said top cap member being attached to said overlapped corresponding side base panels of said base member by adhesive material at the ends of said side panels of said base member, adhesive means attaching said front and rear panels of said top cap member to said front and rear panels of said base member to permit the insertion of the user's fingers therebetween for readily separating said front and rear panels of said top cap members from said front and rear panels of said base member, and said side cover panels being readily separable at their mid-portions from corresponding mid-portions of said side base panels, respectively, to permit the insertion of a user's fingers therebetween and the removal of said top cap member by manual separation of the attached panels and lifting thereof.

* * * * *